US005137073A

United States Patent [19]

Huang

[11] Patent Number: 5,137,073

[45] Date of Patent: Aug. 11, 1992

[54] CHAIN PULLING DEVICE

[75] Inventor: Chun C. Huang, Taipei, Taiwan

[73] Assignee: Teh Yor Industrial Co., Ltd., Taiwan, Taiwan

[21] Appl. No.: 657,435

[22] Filed: Feb. 19, 1991

[51] Int. Cl.[5] ..... E06B 9/56

[52] U.S. Cl. ..... 160/321; 160/319; 160/323.1; 475/331

[58] Field of Search ..... 160/323.1, 321, 319, 160/294; 475/317, 331

[56] References Cited

U.S. PATENT DOCUMENTS

| | | | |
|---|---|---|---|
| 4,139,044 | 2/1979 | Brolin | 160/321 |
| 4,448,233 | 5/1984 | Rombouts | 160/319 |
| 4,513,805 | 4/1985 | Mase | 160/299 |
| 4,657,060 | 4/1987 | Kaucic | 160/176.1 X |
| 4,681,279 | 7/1987 | Nakamura | 160/294 X |
| 4,712,599 | 12/1987 | Komaki | 160/176.1 X |
| 4,830,081 | 5/1989 | Morris | 160/168.1 |

*Primary Examiner*—Blair M. Johnson

[57] ABSTRACT

A pulling device for a roll shaft for roller blinds or screens comprises a housing, a chain pulley situated in the housing and a chain slung around the pulley. The chain is formed by a cord with a number of beads distributed at regular interval along the length. The pulley is provided with a central channel and a series of notches at the periphery to receive the cord portion and the beads of the chain, respectively. The chain is readily pulled to drive the pulley and, in turn, the roller shaft, to wind up or to unwind a roller blind or screen. When the pulling force is released the pulley will be automatically braked by means of the chain itself by the gravity of the roller blind or screen.

1 Claim, 2 Drawing Sheets

CHAIN PULLING DEVICE

BACKGROUND OF THE INVENTION

1. Field of the Invention

This invention relates to a chain pulling device for a roller shaft for roller blinds or screens, comprising a housing, a chain pulley provided with a central channel and a series of notches at the periphery and situated in the housing, and a chain slung around the pulley.

2. Description of the Prior Art

U.S. Pat. No. 4,448,233 discloses a pulling device of this type which comprises a cord pulley situated in a housing and a clamp disposed in a chamber in said housing and about said cord, said clamp becomes operative when turning the cord pulley by the weight of the blind or screen. This pulley device cannot be used with a chain, and even with a cord the clamp is ineffective since the cord will slip sometimes over said clamp.

SUMMARY OF THE INVENTION

It is a primary object of the present invention to provide a pulling device for a roll shaft for roller blinds or screens, which can be used with a chain formed by a cord with a number of beads distributed at regular interval along the length and effectively braked by the chain itself without any clamp or the like.

This object is attained according to the invention with a pulling device comprising a housing, a chain pulley situated in said housing and a chain slung around said pulley, said chain is formed by a cord with a number of beads distributed at regular interval along the length, and said pulley is provided with a central channel and a series of notches at the periphery to fittingly receive said cord portion and said beads of said chain, respectively.

The present invention has the advantage that it is readily to pull the chain to drive the chain pulley and in turn the associated roll shaft to wind up or to unwind a roller blind or screen, and when the pulling force is released the pulley will be automatically and effectively braked by means of the chain itself by the gravity of said roller blind or screen.

According to the present invention, the chain pulley can be further constructed to have a variable speed gear arrangement for the reduction of the pulling force necessary for the winding up and unwinding of the roller blinds or screens to be actuated.

The aforementioned and other objects, features and advantages will be better understood by the following detailed description in connection with the accompanying drawings in which like reference symbols designate like parts throughout the figures.

DESCRIPTION OF PREFERRED EMBODIMENTS

Figure 1:
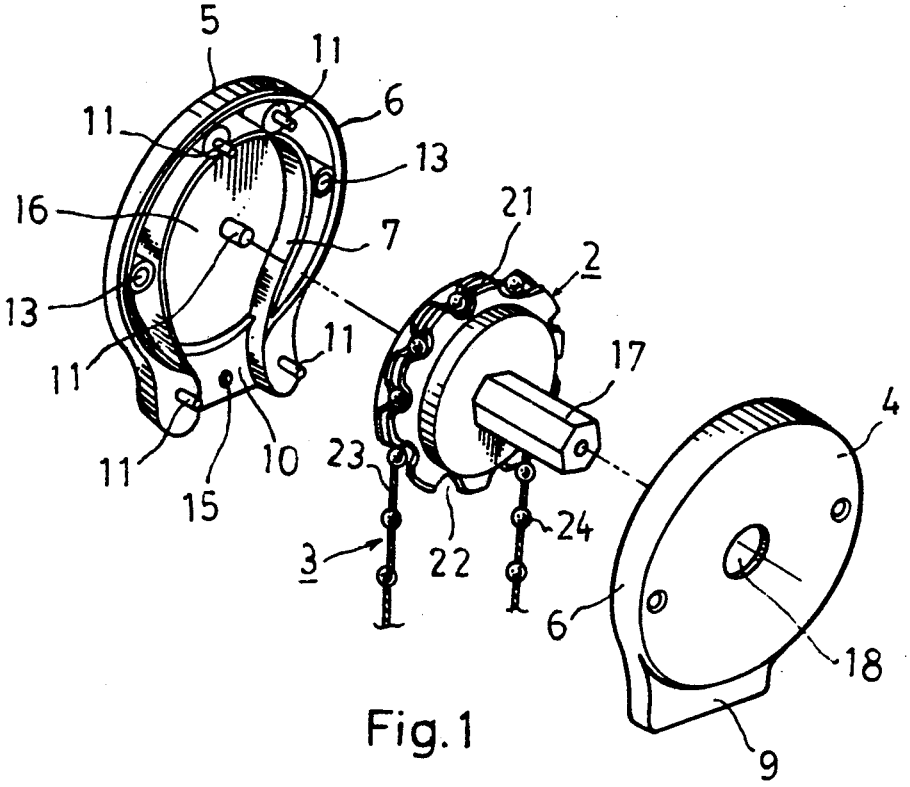
FIG. 1 is an exploded perspective view of the pulling device according to first embodiment of the invention, a part of the chain being cut away.
Figure 2:
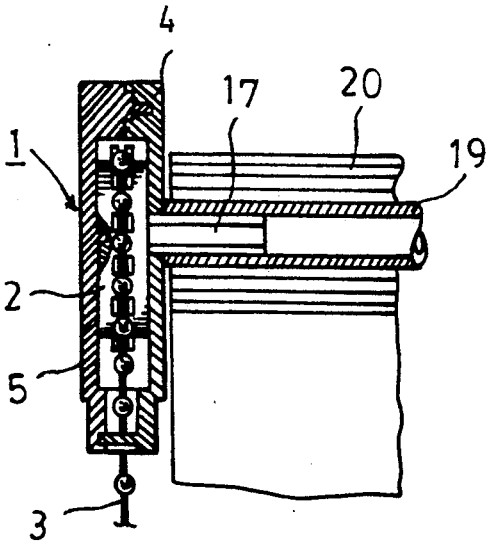
FIG. 2 is an elevational cross section view of the pulling device of first embodiment in combination with a part of the roll shaft and the roller blind or screen.
Figure 3:
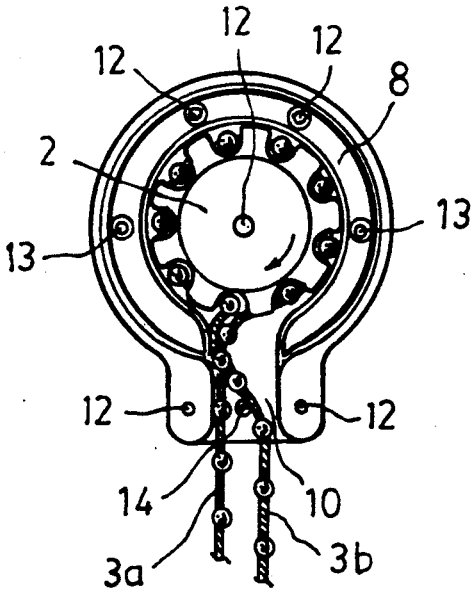
FIG. 3 is an elevational plane view of the pulling device with a part removed to illustrate the brake action caused by the chain itself.

Now, referring to FIGS. 1 to 3, the pulling device according to the invention comprises mainly a housing 1, a chain pulley 2 and a chain 3. The housing 1 consists of two halves, with one half as the base 4 and another half as the cover 5. The housing 1 is in general circular configuration having an outer wall 6 and an inner wall 7 to define an annular space 8 therebetween. A tongue 9 is integrally extended from the housing 1 at bottom side, to form an opening 10. A plurality of pins 11 are formed in the annular space 8, at the center and the side wall of the opening 10 in the cover 5, respectively, for the engagement with corresponding holes 12 at aligned locations in the base 4. The apertures 13 are used for the passage of fastening means in case that the pulling device is to be mounted into the bay of a sash or to a separate support, not shown. An additional pin 14 disposed at the center of said opening 10 is to be engaged with corresponding hole 15 to serve as a partition which will divide the opening 10 into two ports to define the passage for the chain 3 in separate inlet and outlet.

The chain pulley 2 is rotatably disposed within the interior space 16 defined by the inner wall 7, with a polygonal spindle 17 projecting through and out of the central opening 18 in the base 4, to be inserted into a roll shaft 19 for a roller blind or screen 20. The pulley 2 is provided with a central channel 21 and a series of notches 22 at the periphery in equal distance.

The chain 3 is formed by a cord 23 with a number of beads 24 distributed at regular interval along the length. The chain 3 is slung aroung the chain pulley 2. When the cord portion 23 of the said chain 3 is fittingly received into the channel 21, each bead 24 is just located in respective notch 22. The chain 3 is preferably an endless chain and only a portion of the chain 3 is illustrated.

In operation, when the chain 3 at left hand part as shown in FIG. 3 is pulled down as output chain 3*a*, the pulley 2 is turned counter-clockwise. Meanwhile, the chain 3 at right hand part is pulled up as input chain 3*b* which will be forced into the channel 21 by the inner wall 7, so that the pulley 2 will be continuously turned. The pulley 2 in turn rotates the roll shaft 19 via its spindle 17 to wind up the roller blind or screen 20. As soon as the pulling force is released, the gravity of the roller blind or screen 20 exerts a load onto the roll shaft 19 to make it rotate in opposite direction as indicated by the arrow. In this case, the cord portion of the right hand chain part 3*b* still contained within the channel 21 will not pulled down and rather rotated along with the pulley 2 passing over the location of the opening 10. But the notch 22 just above the opening 10 is occupied by the bead 24 on left hand chain part 3*a*, so that the bead 24 on right hand chain part 3*b* will be blocked by the inner wall 7 at left hand side. The pulley 2 is thus automatically and effectively braked by the chain 3 itself and the reverse rotation of the roll shaft 19 is thus completely stopped.

Figure 4:
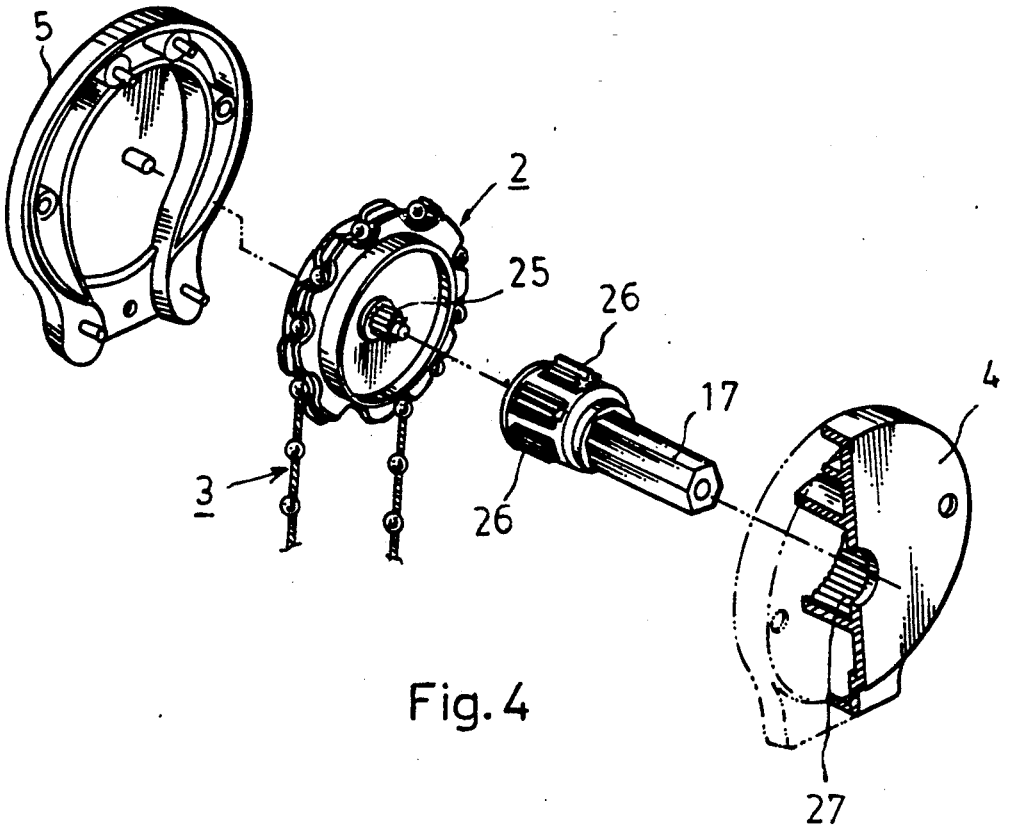
FIG. 4 is similar to FIG. 1 but illustrates a second embodiment of the invention, provided with a variable speed gear arrangement.
Figure 5:
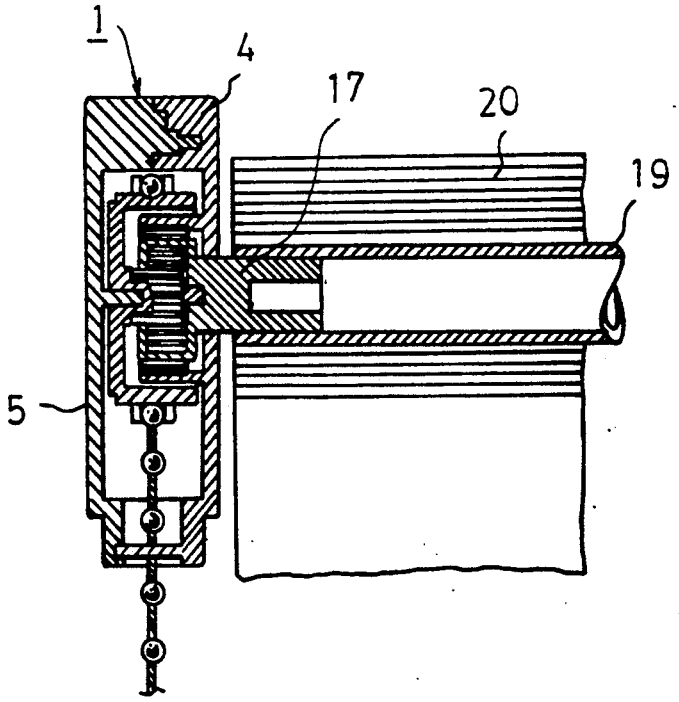
FIG. 5 is an elevational cross section view of the pulling device of second embodiment in combination with a part of the roll shaft and the roller blind or screen.

In another embodiment as shown in FIGS. 4 and 5, the chain pulley 2 is constructed to have a variable speed gear arrangement, for example, in the type of planetary gear trains comprising a sun gear 25 at the center of the pulley 2, a plurality of planetary pinions 26 around the circumference of the enlarged cylindrical section on the polygonal spindle 17, and a guide gear 27 formed as a central cylinder in the base 4. All these gears 25, 26 and 27 have straight teeth to mesh with one another.

The operation of the pulley in second embodiment is just the same as aforementioned first embodiment, provided that the gear arrangement in the second embodiment makes it easier and costs less power to operate the roll shaft 19 to wind up and unwind the roller blind or screen 20. The chain pulley 2 is in all the same way to exert an automatic and effective brake by the chain 3 itself.

While there have been shown and described what are at present considered the preferred embodiments of the present invention, it will be obvious to those skilled in the art that various changes and modifications may be made therein without departing from the scope of the invention as defined by the appended claims.

What I claim is:

1. A pulling device for a roll shaft for roller blinds and screens comprising, in combination:

a housing having two halves, wherein one half is a base provided with a central opening, and the other half is a cover, said housing having an outer wall, an inner wall defining an interior space, a chain inlet opening and a chain outlet opening;

a chain pulley situated within said interior space of said housing, said pulley having a spindle, a central channel and a plurality of notches at its periphery, said spindle having an enlarged cylindrical section and extending through and out of said central opening provided in said base of said housing a chain formed by a cord having a desired length and thickness, said thickness defined so as to be frictionally and fittingly received in said central channel, and a plurality of beads distributed at regular intervals along the length of said cord such that when said cord portion is frictionally and fittingly received in said channel each said bead is located in each of said notches respectively;

a variable speed gear arrangement comprising a sun gear at the center of said chain pulley, a plurality of planetary pinions around a circumference of the enlarged cylindrical section of said spindle, and a guide gear being formed as a central cylinder in said base of said housing, all said gears having straight teeth to mesh with one another whereby a pulling force necessary to wind up and unwind the roller blinds or screens is reduced.

* * * * *